US007903050B2

(12) United States Patent
Kimura et al.

(10) Patent No.: US 7,903,050 B2
(45) Date of Patent: Mar. 8, 2011

(54) IMAGE DISPLAY APPARATUS AND DRIVING METHOD THEREOF

(75) Inventors: Yuichiro Kimura, Yokohama (JP); Shunji Ohta, Kawasaki (JP); Yoshinori Miyazaki, Yokohama (JP)

(73) Assignee: Fujitsu Hitachi Plasma Display Limited, Kanagawa (JP)

( * ) Notice: Subject to any disclaimer, the term of this patent is extended or adjusted under 35 U.S.C. 154(b) by 1327 days.

(21) Appl. No.: 11/291,931

(22) Filed: Dec. 2, 2005

(65) Prior Publication Data

US 2006/0132659 A1 Jun. 22, 2006

(30) Foreign Application Priority Data

Dec. 3, 2004 (JP) ..... 2004-351569
Mar. 31, 2005 (JP) ..... 2005-101325

(51) Int. Cl.
*G09G 3/28* (2006.01)

(52) U.S. Cl. ..... 345/63

(58) Field of Classification Search ..... 345/60–72, 345/77–78

See application file for complete search history.

(56) References Cited

U.S. PATENT DOCUMENTS

| | | | | |
|---|---|---|---|---|
| 5,721,559 | A * | 2/1998 | Nagakubo | 345/63 |
| 6,061,040 | A | 5/2000 | Onodera et al. | |
| 6,100,859 | A | 8/2000 | Kuriyama et al. | |
| 2001/0035850 | A1 * | 11/2001 | Okamoto et al. | 345/77 |
| 2002/0145575 | A1 | 10/2002 | Tong et al. | |
| 2005/0052364 | A1 * | 3/2005 | Otawara et al. | 345/63 |
| 2005/0083258 | A1 * | 4/2005 | Choi | 345/60 |
| 2005/0134534 | A1 * | 6/2005 | Yamada et al. | 345/63 |
| 2005/0212727 | A1 * | 9/2005 | Lee | 345/63 |

FOREIGN PATENT DOCUMENTS

| | | |
|---|---|---|
| EP | 0 686 993 | 12/1995 |
| EP | 1 542 198 | 6/2005 |
| JP | 8-223507 | 8/1996 |
| JP | 8-305321 | 11/1996 |
| JP | 9-34404 | 2/1997 |
| JP | 9-68945 | 3/1997 |
| KR | 10-2004-0085355 | 10/2004 |
| WO | WO2004/025612 | 3/2004 |

* cited by examiner

*Primary Examiner* — Amr Awad
*Assistant Examiner* — Kenneth Bukowski
(74) *Attorney, Agent, or Firm* — Antonelli, Terry, Stout & Kraus, LLP.

(57) ABSTRACT

In a conventional image display apparatus, since display load ratios for respective lines are different, voltage drop amounts are also different and a difference in brightness occurs in spite of giving the same inputted luminance signal, so that image quality of display image is degraded. In the case where signals at the same luminance level are inputted and displayed, for a pixel on a display panel, an ON pattern of a subfield in one field is changed when a line load ratio of a line including the pixel is changed. That is, an image display apparatus using a display panel having a plurality of pixels is configured so as to include, for each of the plurality of pixels connected to one driving electrode, a load calculating means that calculates the load ratio and a luminance correcting means that calculates a drop amount in luminance level of an inputted video signal for correction.

4 Claims, 14 Drawing Sheets

*FIG. 7*

| LUMINANCE LEVEL | SUBFIELD (WEIGHT) | SF8 (128) | SF7 (64) | SF6 (32) | SF5 (16) | SF4 (8) | SF3 (4) | SF2 (2) | SF1 (1) |
|---|---|---|---|---|---|---|---|---|---|
| ⋮ | | | | | | | | | |
| 127 | | × | ○ | ○ | ○ | ○ | ○ | ○ | ○ |
| 128 | | ○ | × | × | × | × | × | × | × |
| 129 | | ○ | × | × | × | × | × | × | ○ |
| ⋮ | | | | | | | | | |
| 135 | | ○ | × | × | × | × | ○ | ○ | ○ |
| ⋮ | | | | | | | | | |
| 256 | | ○ | ○ | ○ | ○ | ○ | ○ | ○ | ○ |

○ : ON
× : OFF $$y=B \cdot f1(x)+(1-B) \cdot f2(x)$$
$$=B \cdot A1 \cdot (1-x)+(1-B) \cdot A2 \cdot (1-x)$$

IMAGE DISPLAY APPARATUS AND DRIVING METHOD THEREOF

CROSS-REFERENCE TO RELATED APPLICATION

The present application claims priority from Japanese patent application No. JP 2004-351569 filed on Dec. 3, 2004 and No. JP 2005-101325 filed on Mar. 31, 2005, the contents of which are hereby incorporated by reference into this application.

BACKGROUND OF THE INVENTION

The present invention relates to an image display apparatus and its driving method and, particularly, to the image display apparatus driven by a common driving electrode per predetermined number of pixels or per predetermined display region on a display panel and to the driving method thereof.

Conventionally, a plasma display apparatus using a plasma display panel (PDP) for a surface discharge has been commercially available as a flat-type image display apparatus, and has been used as, for example, a display apparatus such as a personal computer and a work station, a flat-type wall-mounted television, and a apparatus for displaying advertisements, information, or others. Also, a flat-type image display unit such as an EL panel has also been used as a display unit for a cellular phone or a personal digital assistant (PDA). These flat-type image display apparatuses such as plasma display apparatuses and EL panels are driven by a common driving electrode with respect to a pixel of one scanning-directional line in a display panel having a plurality of pixels. Note that the present invention is not limited to an image display apparatus driven by the common driving electrode with respect to the pixel of the one scanning-directional line, and may be directed to an image display apparatus driven by the common driving electrode per predetermined number of pixels on a display panel having the plurality of pixels or an image display apparatus driven by the common driving electrode per predetermined display region.

FIG. 1 is a block diagram schematically showing a plasma display apparatus as one example of a conventional image display apparatus and shows one example of a three-electrode surface discharge AC plasma display apparatus. In FIG. 1, a reference numeral "1" denotes an image display apparatus (plasma display apparatus), "2" denotes a display panel (plasma display panel: PDP), "3" denotes an address data driver circuit unit, "4" denotes an X driver circuit unit, "5" denotes a Y driver circuit unit, "6" denotes a scan driver circuit unit, and "7" denotes a control circuit unit.

The plasma display apparatus 1 includes the PDP 2; the X driver circuit unit 4, the Y driver circuit unit 5, the address data driver circuit unit 3, and the scan driver circuit unit 6 for driving each display cell of the PDP 2; and the control circuit unit 7 that controls each of these driver circuit units 3 to 6. The control circuit unit 7 includes, for example, a display data control section 71 to which video signals of three primary colors, R (red), G (green), and B (blue) are supplied from an external apparatus such as a TV tuner or a computer, and a timing generating section 72 to which various synchronization signals (a dot clock signal CLK, a blanking signal XBLANK, a horizontal synchronization signal XHsync, and a vertical synchronization signal XVsync) are supplied. The control circuit unit 7 (display data control section 71 and timing generating section 72) outputs a control signal suitable for each of the driver circuit units 3 to 6 from the above-mentioned video signals (R, G, and B) and various synchronization signals (CLK, XBLANK, XHsync, and XVsync), thereby making a predetermined image display. Note that, for example, for a desired gray-scale display, one field is converted by the display data control section 71 into a combination of a plurality of subfields each having a predetermined weight of luminance.

FIG. 2 is a view for explaining a problem arising in the conventional image display apparatus, and conceptually shows the case where an image in which the entire screen is gray (for example, at a luminance level of 135 out of 256 luminance levels) and only partial regions (P21 and P22) are black (at a luminance level of 0) is displayed.

As shown in FIG. 2, in the conventional image display apparatus (for example, plasma display apparatus), when the image in which the entire screen is at a luminance level of 135 and the only partial regions P21 and P22 are at a luminance level of 0 is displayed, a voltage drop state on its line (display line including pixels corresponding to the regions P21 and P22) is different from that on another line (display line having only the pixels that become at a luminance level of 135), whereby a difference in brightness occurs on the display image and the image quality is degraded.

Specifically, for example, on the lines including the pixels corresponding to the regions P21 and P22 at a luminance level of 0, a display ratio is smaller than that on the other lines having only the pixels that becomes at a luminance level of 135, so that the voltage drop state is also low. As a result, in FIG. 2, on the line including the pixels corresponding to the regions P21 and P22, for example, regions P31, P32, and P33 are brighter than another region (region P1), whereby non-uniformity (luminous difference: difference in brightness) is caused on the display image.

Moreover, since size of the regions P21 and P22 at a luminance level of 0 is changed in directions of arrows (horizontal direction), the brightness of the regions P31, P32, and P33 is also changed. That is, if each size of the regions P21 and P22 is increased, the voltage drop is further decreased, so that the regions P31, P32, and P33 (on the same line) driven by a common electrode together with the regions P21 and P22 become further brighter. Conversely, if each size of the regions P21 and P22 is decreased, the voltage drop is increased (to become close to a voltage drop on the other display lines), so that the regions P31, P32, and P33 driven by the common electrode together with the regions P21 and P22 become darker (the brightness becomes closer to the brightness of another region P1).

This is not only a problem of luminance in a monochrome display image but also a problem of being directly related to non-uniformity of color tone in a color display image. In this specification, the "difference in brightness on display image" has a broad meaning including such color non-uniformity of each color (for example, R, G, and B). Also, in this specification, the "pixel" includes, for example, both of individual cells of R, G, and B on the color display panel and a pixel constituted from one set of R, G, and B.

Note that FIG. 2 shows the case where the common driving electrode (for example, X electrode and Y electrode) is provided per predetermined number of pixels (pixel on one line) in a scanning direction. This common electrode is not limited to an electrode provided per scanning-directional line. If the electrode is provided per predetermined display region, a difference in brightness on a display image occurs per region driven by the common driving electrode.

As described above, in the plasma display apparatus, for example, the difference in brightness (luminous difference) per predetermined number of pixels (pixels on one line) driven by the common electrode occurs essentially due to the voltage drops on the X electrode and the Y electrode caused by a sustain discharge current (sustain current). Generally, in the conventional plasma display apparatus, the difference in brightness between lines has been reduced (resolved) by decreasing a bus impedance and a sustain current themselves.

Also, to prevent a luminous difference between lines depending on a display date amount for each line, there is proposed a scheme (for example, Patent Document 1: Japanese Patent Laid-Open Publication No. 09-068945) of counting the display data amount detected per line and controlling the number of times of the sustain discharges (the number of sustain pulses) per line. In principle, this scheme can be expected to be significantly effective for a luminous difference, flicker, and gray-scale linearity occurring per common electrode. However, in order to achieve sufficient effects, control is required per subfield (SF).

SUMMARY OF THE INVENTION

As described above, in the conventional image display apparatus (plasma display apparatus), a difference in brightness between lines has been reduced by, for example, decreasing a bus impedance and a sustain current themselves.

However, even through the bus impedance and the sustain current are decreased, these bus impedance and sustain current cannot completely be eliminated. Therefore, the difference in brightness per predetermined number of pixels driven by the common electrode cannot be sufficiently resolved. This problem has become increasingly significant with demands in recent years for larger display panel size and higher addressability.

Also, in order to achieve the sufficient effects in the conventional scheme of counting the display data amount detected per line and controlling the number of sustain pulses per line, the number of sustain pulses has to be controlled per subfield. This requires not only a dedicated driver circuit but also a circuit for calculating the number of sustain pulses per common electrode, a circuit for supplying the count results to a driver circuit, and others, so that there have been the problems of increasing the circuit size and, also, in view of cost, boosting the price of the image display apparatus.

In view of the above-described problems of the conventional image display apparatus, an object of the present invention is to provide an image display apparatus, which is capable of correcting the difference in brightness occurring on the display image per predetermined number of pixels or per predetermined display region driven by the common driving electrode and improving image quality of the display image, and to provide a driving method of the image display apparatus. That is, the present invention is dedicated to reduce (resolve) the difference in brightness (luminous difference) occurring depending on the display contents based on the video signal per common electrode, and, with a very simple circuit and without requiring a special driver circuit, is capable of correcting the difference in brightness occurring on the display image per predetermined number of pixels or per predetermined display region driven by the common driving electrode and improving image quality of the display image.

According to a first phase of the present invention, a driving method of an image display apparatus, in which a signal at a same luminance level is inputted to a pixel on a display panel and is displayed, comprises the step of: when a line load ratio of a line including said pixel is changed, an On pattern of a subfield in one field is changed.

According to a second phase of the present invention, a driving method of an image display apparatus, which is driven by a common driving electrode per predetermined number of pixels or per predetermined display region in a display panel having a plurality of pixels, comprises the steps of: calculating, per said common driving electrode, a functional amount associated with a brightness in accordance with an image to be displayed; and, based on the calculated functional amount, correcting the brightness of the image to be displayed on said predetermined number of pixels or said predetermined display region driven by said common driving electrode.

According to a third phase of the present invention, an image display apparatus using a display panel having a plurality of pixels comprises: a load calculating means for calculating, at a time of inputting and displaying a signal with a same luminance level to a pixel on a display panel, a line load ratio of a line including said pixel; and a correcting means for correcting, in accordance with an output of said load calculating means, a luminance by changing an On pattern of a subfield in one field.

According to a fourth phase of the present invention, an image display apparatus using a display panel having a plurality of pixels comprises: a load calculating means for calculating a load ratio of each of a plurality of pixels connected to one driving electrode; and a luminance correcting means for calculating and correcting, based on an output of said load calculating means, a drop amount of luminance level of an inputted video signal.

According to a fifth phase of the present invention, an image display apparatus driven by a common driving electrode per predetermined number of pixels or per predetermined display region in a display panel having a plurality of pixels comprises: a calculating means for calculating, per said common driving electrode, a functional amount associated with a brightness in accordance with an image to be displayed; and a correcting means for correcting, based on an output of said calculating means, the brightness of the image to be displayed on said predetermined number of pixels or predetermined display region driven by said common driving electrode.

According to the present invention, without increasing the large-sized circuits and the manufacture costs, the image display apparatus driven by the common driving voltage per predetermined number of pixels or per predetermined display region on the display panel corrects the difference in brightness occurring due to the image displayed per predetermined number of pixels or per predetermined display region driven for each common driving electrode, whereby the quality of display image can be improved.

BRIEF DESCRIPTION OF THE DRAWINGS

FIG. 7 is a view for explaining an example of the driving method of the image display apparatus according to one embodiment of the present invention.

DESCRIPTION OF THE PREFERRED EMBODIMENTS

The present invention seeks a predetermined functional amount depending on a displace content to be displaced per common electrode driven by a displace device, and controls a brightness of the display device driven for each common electrode based on the sought functional amount.

With reference to the attached drawings, an embodiment of the image display apparatus and a driving method thereof will be described in detail below.

Embodiment

Figure 3:
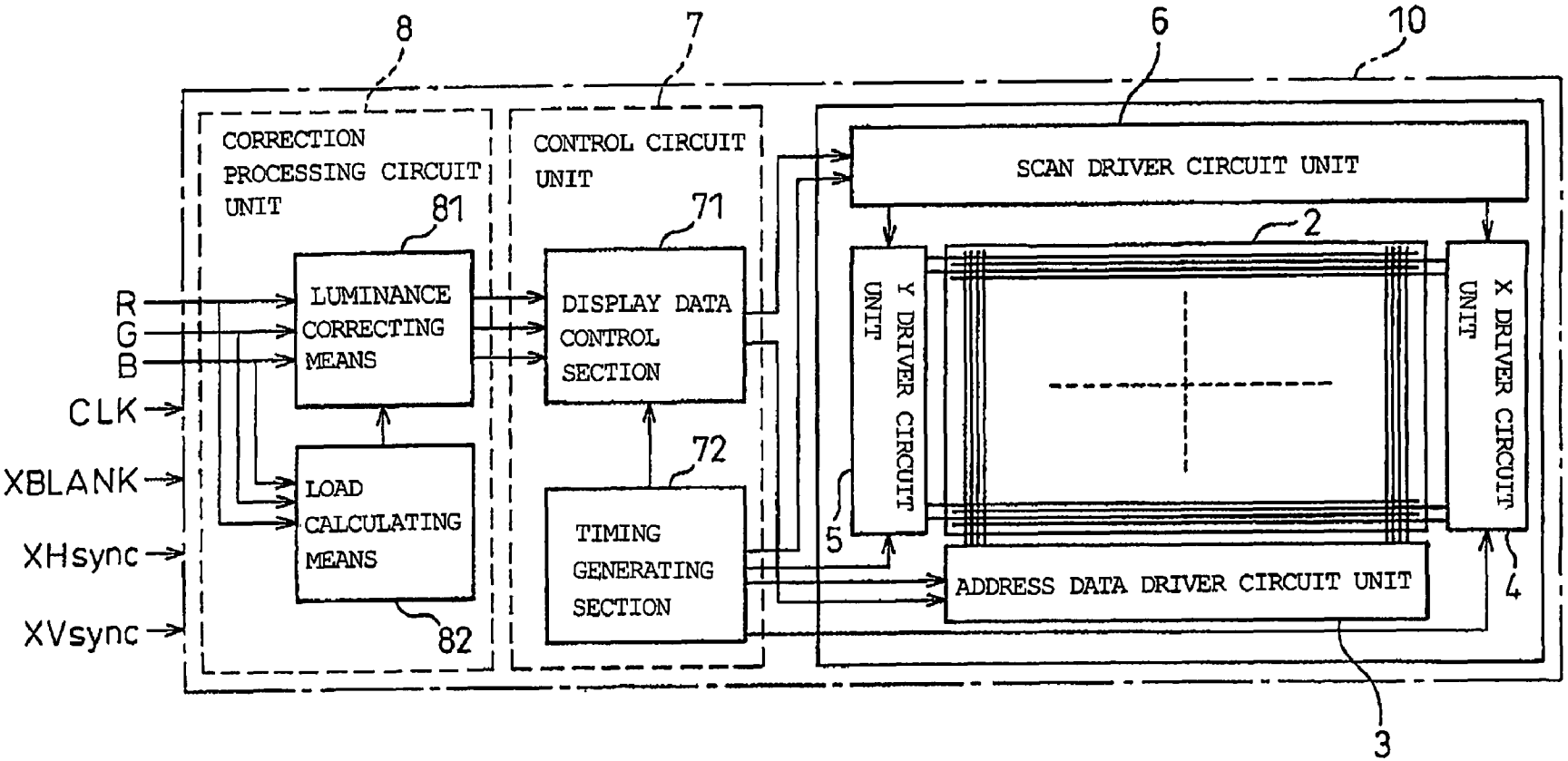
FIG. 3 is a block diagram schematically showing a plasma display apparatus as an image display apparatus according to one embodiment of the present invention.

FIG. 3 is a block diagram schematically showing a plasma display apparatus as an image display apparatus according to one embodiment of the present invention, and shows one example of a three-electrode surface discharge AC plasma display apparatus. In FIG. 3, a reference numeral "10" denotes an image display apparatus, "2" denotes a display panel (PDP), "3" denotes an address data driver circuit unit, "4" denotes an X driver circuit unit, "5" denotes a Y driver circuit unit, "6" denotes a scan driver circuit unit, "7" denotes a control circuit unit, and "8" denotes a correction processing circuit unit.

Figure 1:
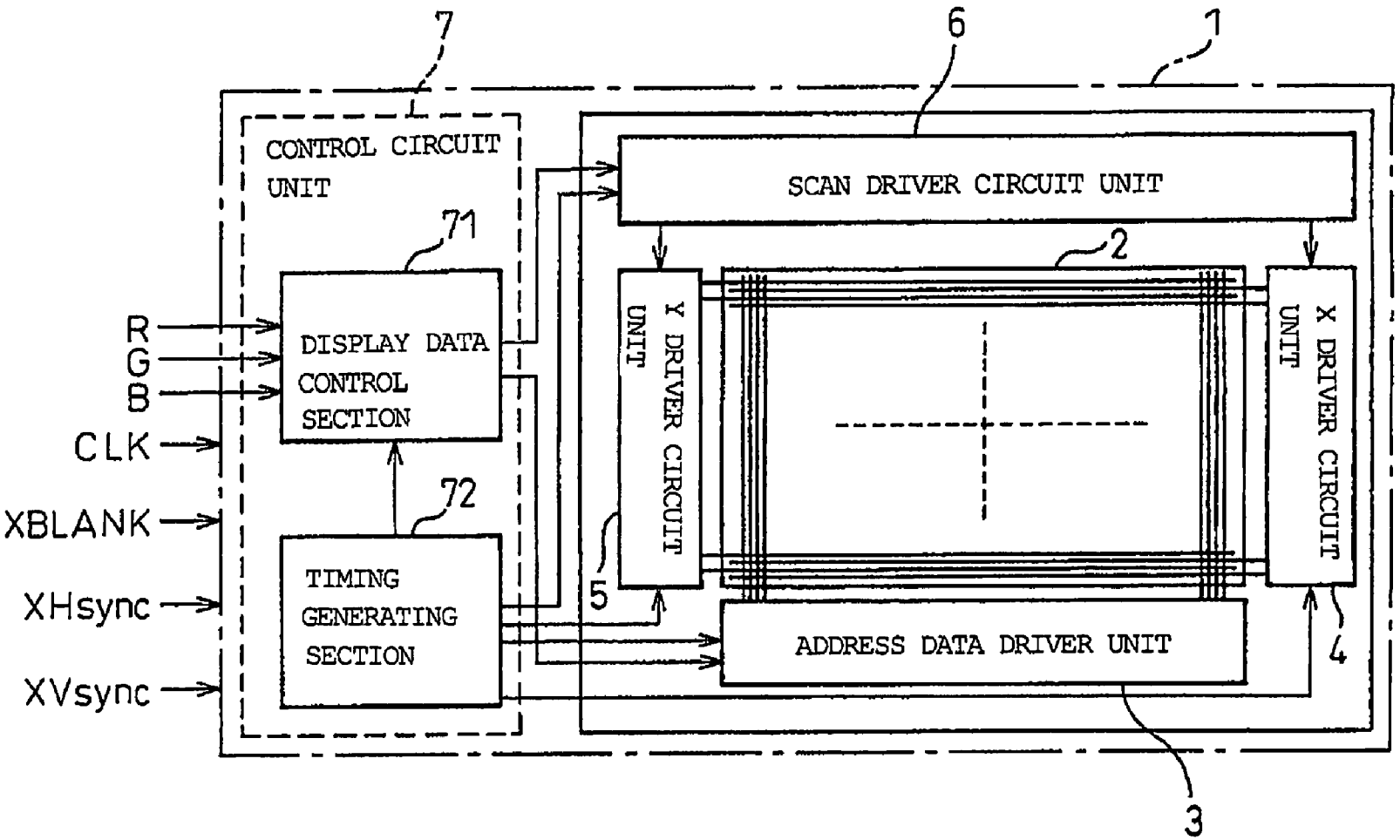
FIG. 1 is a block diagram schematically showing a plasma display apparatus as one example of a conventional image display apparatus.

As evident from a comparison between FIG. 3 and FIG. 1 described above, in summary, the image display apparatus (plasma display apparatus) 10 according to the present embodiment is equivalent to the conventional plasma display apparatus 1 having added thereto the correction processing circuit unit 8.

That is, the plasma display apparatus 10 according to the present embodiment includes the PDP 2; the X driver circuit unit 4, the Y driver circuit unit 5, the address data driver circuit unit 3, and the scan driver circuit unit 6 for driving each display cell of the PDP 2; the control circuit unit 7 that controls each of these driver circuit units 3 to 6; and the correction processing circuit unit 8 that corrects a difference in brightness occurring on a display image per predetermined number of pixels or per predetermined display region driven by a common driving electrode.

The correction processing circuit unit 8 is provided with, for example, a load calculating means (calculating means) 82 to which video signals of three primary colors of R (red), G (green), and B (blue) are inputted from an external apparatus such as a TV tuner or a computer, and a luminance correcting means 81 to which the above-mentioned video signals (R, G, and B) and an outputted signal of the load calculating means 82 are inputted.

The load calculating means 82 calculates (detects), for each common driving electrode, a functional amount associated with the brightness depending on an image to be displayed. The luminance correcting means 81 corrects (controls), based on the output of the load calculating means 82, the brightness of the image to be displayed at the predetermined number of pixels (pixels on one line) driven by the common driving electrode. Note that, as a matter of course, the signal to be inputted may be a luminance signal.

That is, the load calculating means 82 calculates, for example, an average luminance level of signals corresponding to the pixels on one line or a data amount associated with a voltage drop of a signal corresponding to the pixels on one line. Also, in accordance with the output of the load calculating means 82, the luminance correcting means 81 (correction amount calculating means 813) uses, for example, an approximately linear characteristic, a non-linear characteristic (a secondary characteristic), or a combination function of approximately linear characteristics (a broken-line characteristic) to adjust a gain of a video signal corresponding to the pixels on one line or a gamma characteristic of the video signal corresponding to the pixels on one line, thereby correcting the brightness of the image.

The control circuit unit 7 is provided with a display data control section 71 to which the video signals (R, G, and B) are inputted, and a timing generating unit 72 to which various synchronization signals (CLK, XBLANK, XHsynch, XVsync) are inputted. The control circuit unit 7 outputs a control signal suitable for each of the driver circuit units 3 to 6 from the above-mentioned video signals and various synchronization signals, thereby making a predetermined image display. Note that, for example, for a desired gray-scale display, one field is converted by the display data control section 71 into a combination of a plurality of subfields each having a predetermined weight of brightness.

Figure 4:
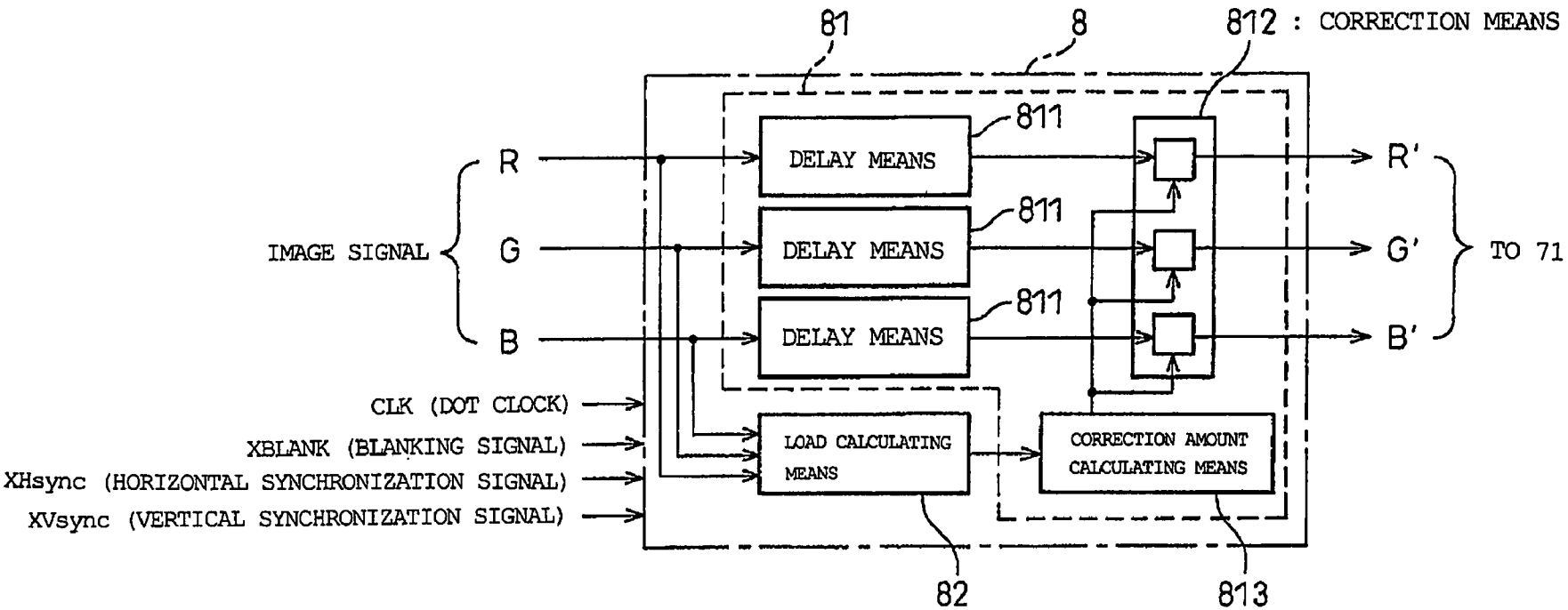
FIG. 4 is a block diagram of luminance correcting means and load calculating means in the image display apparatus shown in FIG. 3.

FIG. 4 is a block diagram showing the luminance correcting means and the load calculating means in the image display apparatus shown in FIG. 3.

As shown in FIG. 4, the luminance correcting means 81 includes a delay means 811 provided for each of the primary-color video signals of R, G, and B, a correcting means 812, and a drop amount calculating means 813 that receives the output of the load calculating means 82 and calculates a correction function.

For example, the load calculating means 82 computes, including the primary-color video signals R, G, and B, the following equation (1) as a functional amount to calculate a load per line and output it to the drop amount calculating means 813. Here, "Xi" represents brightness per cell on one line driven by the common electrode, and "N" represents a total number of cells on one line. That is, a total of each of R, G, and B is independently computed.

$$\sum_{i=1}^{N} Xi/C \tag{1}$$

The correcting means 812 includes, for example, multipliers provided for the respective primary-color video signals R, G, and B, multiplies a correction function (amount of correction) calculated by the drop amount calculating means 813, and outputs the corrected video signals R', G', and B' to the display data control unit 72. Alternatively, the correcting means 812 includes, for example, a look-up table (LUT: memory means) for outputting the corrected video signals R', G', and B' each corresponding to the correction amount calculated by the drop amount calculating means 813.

The delay means 811 is to adjust a delay occurring when the load calculating means 82 seeks a functional amount. For example, the delay means 811 delays and outputs a relevant one of the video signals R, G, and B by a time period equivalent to, for example, one to two horizontal synchronization period as required.

Figure 5A:
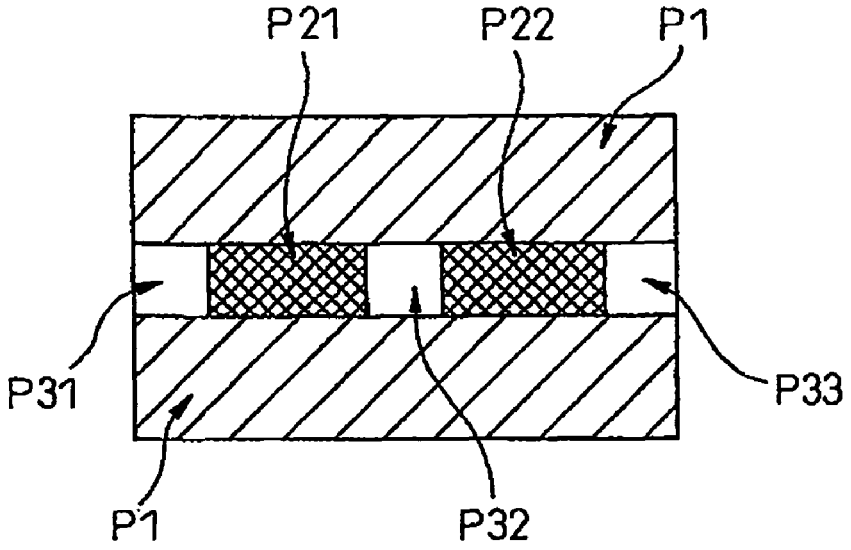
FIG. 5A is a view for explaining a doctrine of a driving method of the image display apparatus according to one embodiment of the present invention.
Figure 5B:
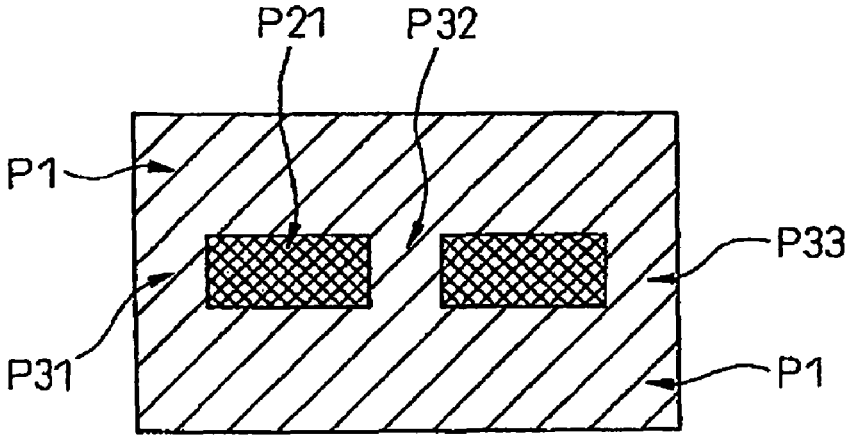
FIG. 5B is a view for explaining a doctrine of a driving method of the image display apparatus according to one embodiment of the present invention.
Figure 5C:
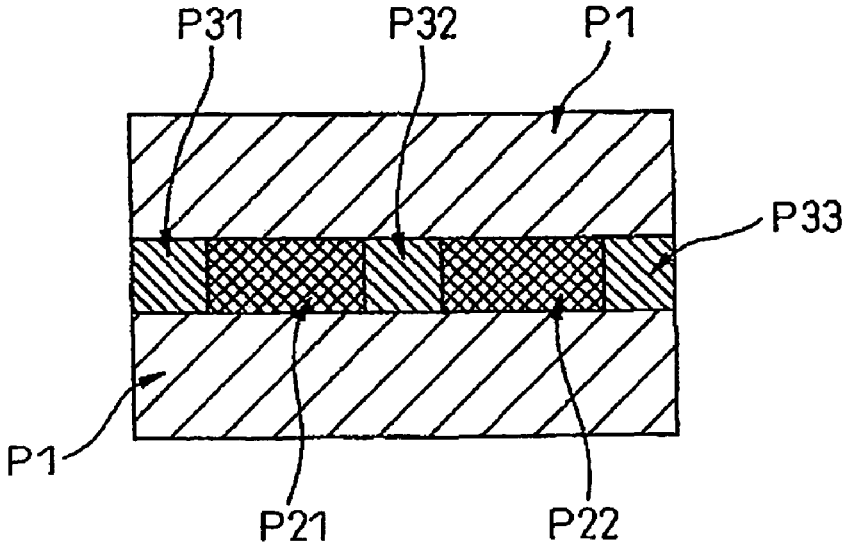
FIG. 5C is a view for explaining a doctrine of a driving method of the image display apparatus according to one embodiment of the present invention.
Figure 6:
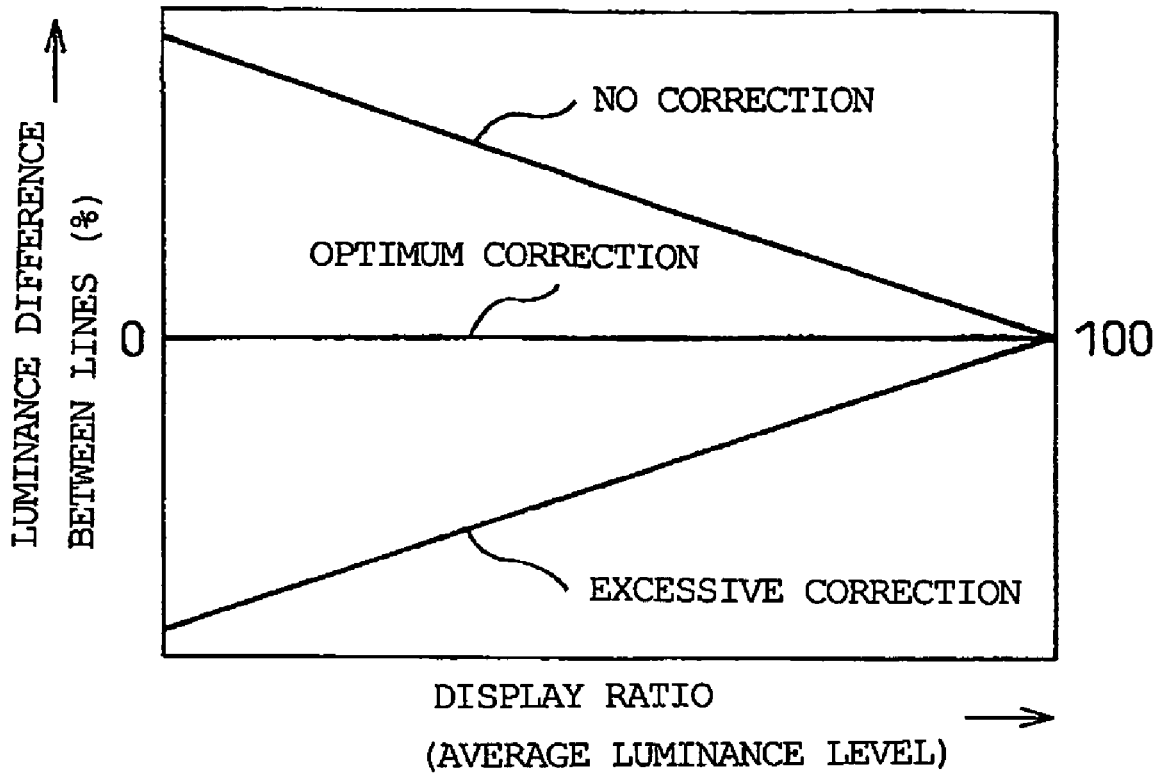
FIG. 6 is a view for explaining a doctrine of the driving method of the image display apparatus according to one embodiment of the present invention.

FIGS. 5A to 5C and 6 are views for explaining doctrines of a driving method of the image display apparatus according to the present invention. FIG. 5A shows the case of a display image without a correction; FIG. 5B shows the case of a display image with an optimum correction; and FIG. 5C shows the case of a display image with an excessive correction. FIG. 6 shows a relation between a luminance difference between lines and a load factor (average luminance level) in the above respective cases.

Figure 2:
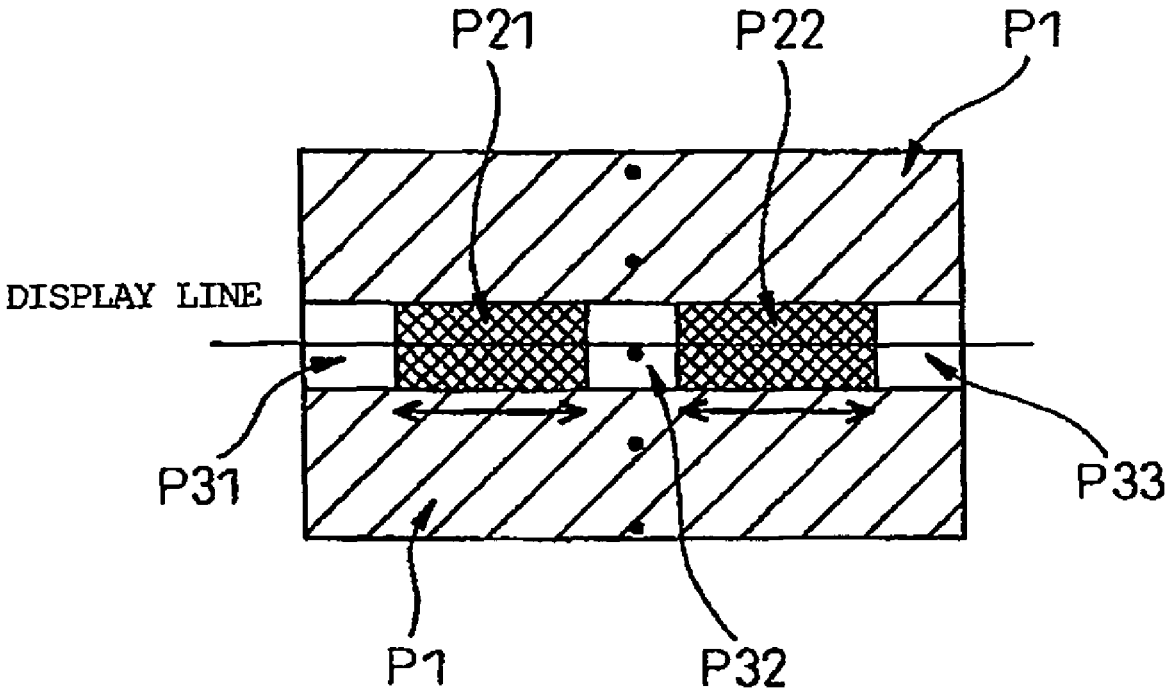
FIG. 2 is a drawing for describing a problem in the conventional image display apparatus.

As described with reference to FIG. 2, for example, when an image with its entire screen at a luminance level of 135 (gray) except the partial regions P21 and P22 at a luminance level of 0 (black) is displayed on a conventional plasma display apparatus, the regions P31, P32, and P33 on a line including the pixels corresponding to the regions P21 and P22 are brighter than the other region P1, thereby causing non-uniformity on the display image (refer to FIG. 5A). This is because varying the display ratios between lines vary the states of voltage drop in the common electrode (for example, X and Y electrodes) for use in driving, thereby varying the brightness of the display image (causing a luminous difference).

As shown in FIG. 6, the image display apparatus according to the present embodiment makes a large correction (correction for decreasing significantly the luminance) on a line with a small load factor (average luminance level) and makes a small correction (correction for decreasing small the luminance) on a line with a large load factor. With this, a display with a uniform brightness is achieved irrespectively of the difference in voltage drop according to the load factor for each line (common electrode: X and Y electrodes) (refer to FIG. 5B). Note that FIG. 5C shows a display image with an excessive correction. If a correction is too large, the regions P31, P32, and P33 are darker than the other region P1.

In the image display apparatus according to the present embodiment, the correction processing circuit unit 8 including the luminance correcting means 81 and the load calculating means 82 corrects image signals for each line to allow a display image as shown in FIG. 5A to be displayed as a display image with a luminous difference between lines being eliminated irrespectively of the load factor as shown in FIG. 5B.

Specifically, for example, as shown in FIG. 5A (corresponding to FIG. 2 described above), when an image with its entire screen at a luminance level of 135 except the partial regions P21 and P22 at a luminance level of 0 is displayed, the state of voltage drop on the display line including the pixels corresponding to the regions P21 and P22 is different from the state of voltage drop on the other lines (the display lines including only the pixels at a luminance level of 135), thereby causing a difference in brightness on the display image.

To get around the above problem, in the present embodiment, for the pixels for display at the luminance level of 135 on the display line including the pixels corresponding to the regions P21 and P22 (the pixels of the regions P31, P32, and P33), an ON pattern of a subfield in one filed is changed in accordance with a line load ratio.

FIG. 7 is a view for explaining an example of the driving method of the image display apparatus according to the present invention. Specifically, as shown in FIG. 7, for the pixels of the regions P31, P32, and P33, an original ON pattern at the luminance level of 135 (wherein SF8 and SF3 to SF1 are turned on, whilst SF7 to SF4 are turned off) is changed to an ON pattern at a luminance level of 128, which achieves an approximately identical brightness to the brightness of the surrounding regions (wherein SF8 is turned on, whilst the SF7 to SF1 are turned off). That is, for the same gray-scale input, the ON pattern of the regions P31, P32, and P33 is made different from the ON pattern of the region P1, thereby absorbing the luminous difference. In short, when signals at the same luminance level are inputted and displayed, the ON pattern of the subfield in one field is changed in accordance with a line load ratio. With this, as shown in FIG. 5B, the region P1 and the regions P31, P32, and P33 have the same brightness.

Figure 8A:
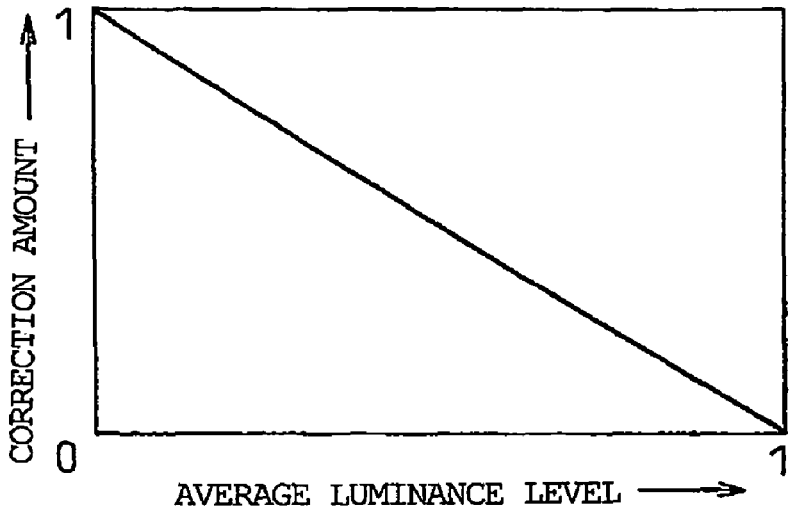
FIG. 8A is a view for explaining a characteristic example of an average luminous level and a correction amount used in the drop amount calculating means in the image display apparatus shown in FIG. 4.
Figure 8B:
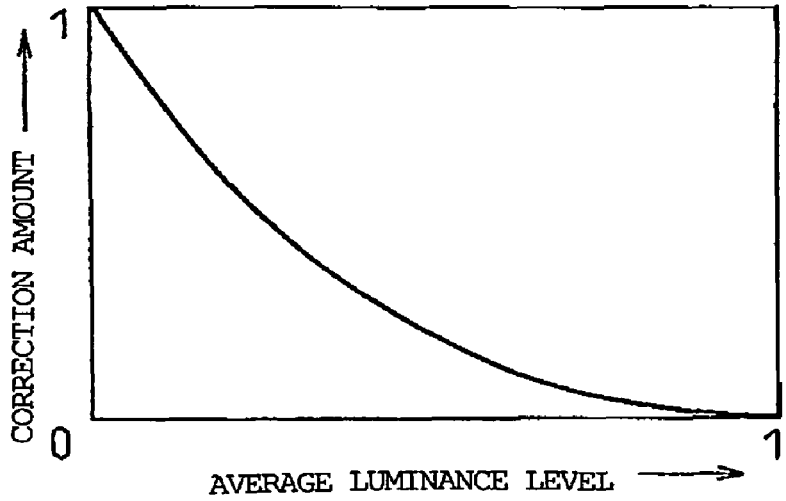
FIG. 8B is a view for explaining a characteristic example of an average luminous level and a correction amount used in the drop amount calculating means in the image display apparatus shown in FIG. 4.
Figure 8C:
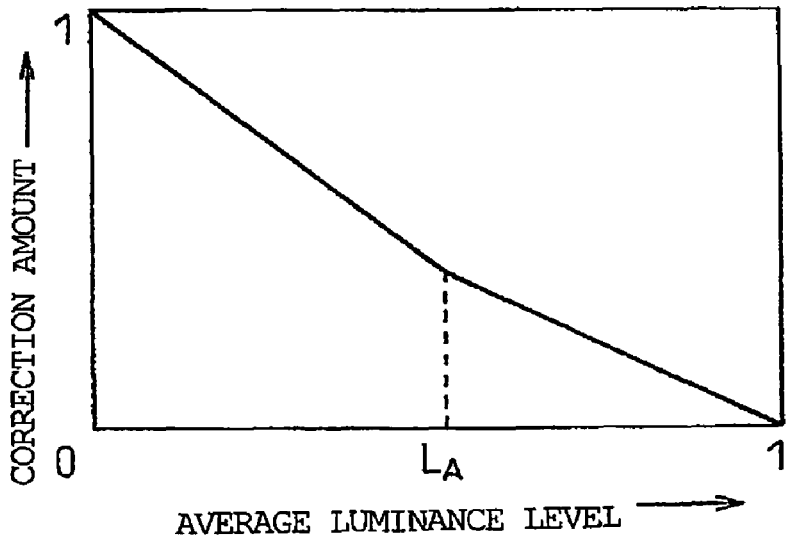
FIG. 8C is a view for explaining a characteristic example of an average luminous level and a correction amount used in the drop amount calculating means in the image display apparatus shown in FIG. 4.

FIGS. 8A to 8C are views for explaining an exemplary characteristic of the line load (average luminance level) and the correction amount used in a correction amount calculating means 813 in the image display apparatus shown in FIG. 4. FIG. 8A shows a linear characteristic; FIG. 8B shows a non-linear characteristic; and FIG. 8C shows a combination function of linear characteristics. Note that the maximal value of the input/output is normalized in one (1).

As described above, in accordance with the output from the load calculating means 82, the correction amount calculating means 813 uses, for example, the approximately linear characteristic (refer to FIG. 8A), the non-linear characteristic (refer to FIG. 8B) or the combination function of the approximately linear characteristics (refer to FIG. 8C) to correct the video signals corresponding to pixels on one line.

Here, if the drop amount calculating means 813 applies the approximately linear characteristic as shown in FIG. 8A, the circuitry can be made small in size and simple in structure. Also, if the drop amount calculating means 813 applies the non-linear characteristic as shown in FIG. 8B (for example, a secondary characteristic), the circuit size is larger than that in the case of the linear characteristic, but correction accuracy can be improved. Furthermore, if the drop amount calculating means 813 applies the combination function of approximately linear characteristics as shown in FIG. 8C, the circuit size can be made small and the correction accuracy can be improved and flexibility in correction can also be improved. Note that FIG. 8C shows the case where two linear characteristics are combined (a broken-line characteristic), wherein the average luminance level is changed at a boundary of a value LA for switching between these liner characteristics. Note that as a matter of course, the number of approximately linear characteristics for combination is not limited to two.

The correcting means 812 can be formed as multipliers multiplying the externally-input video signals R, G, and B by coefficients obtained from an output (a correction coefficient) of the correction amount calculating means 813 and outputting the corrected video signals R', G', and B'. Alternatively, the correcting means 812 can be formed as a look-up table (LUT) having previously stored therein a relation between outputs of the correction amount calculating means 813 and appropriately corrected video signals R', G', and B'.

The above-described brightness correction per common electrode according to the present invention (for example, calculation of the load factor per common electrode and correction of video signals for display using the common electrode) is achieved by, for example, changing the correction amount in a stepwise or successive manner in accordance with the video contents to be displayed.

Figure 9:
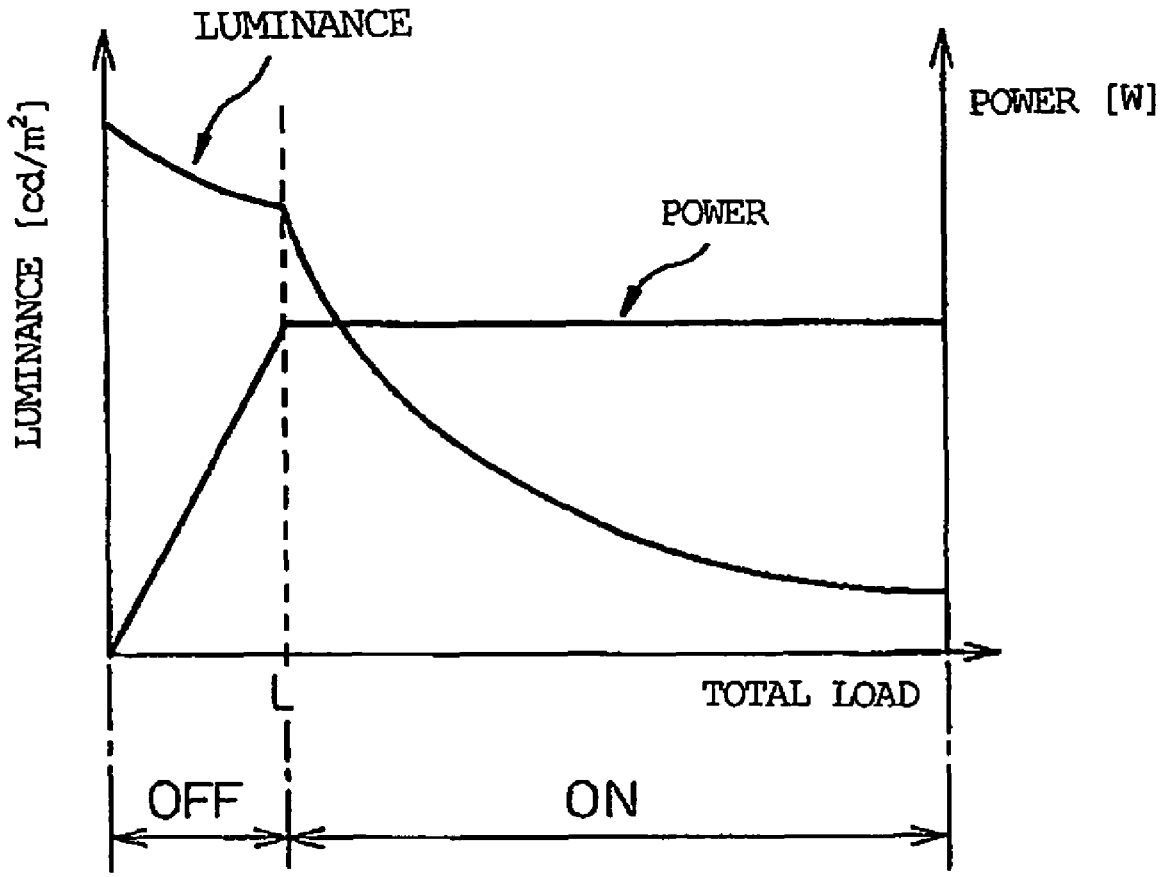
FIG. 9 is a view for explaining an example of the case where the present invention is applied to an image display apparatus with an automatic power control function.

FIG. 9 is a view for explaining the case where the present invention is applied to an image display apparatus having an automatic power control function.

As shown in FIG. 9, conventionally for example, a plasma display apparatus is provided with an automatic power control (APC) circuit for control so that peak power does not exceed a predetermined level in accordance with the video contents (for example, see Japanese Patent Laid-Open Publication No. 8-305321).

The present invention can be applied to an image display apparatus provided with such an APC circuit. That is, the above-described brightness correction processing per common electrode according to the present invention (the load calculating means 82 and the luminance correcting means 81 in FIG. 3) may be turned ON (activated) when the APC circuit is effective (the case where power control is to be performed: the case of a right side of a point "L" in FIG. 9), and may be turned OFF (deactivated) when the APC circuit is ineffective (the case where the power control is not to be performed; the case of a left side of the point "L" in FIG. 9). Also, an ON/OFF control of the brightness correction processing per common electrode according to the present invention can be performed by providing a plurality of thresholds. That is, instead of two steps of ON/OFF, the correction amount can be controlled stepwise. Due to this, a decrease in the peak brightness can be prevented.

Furthermore, the load calculating means and the luminance amount correcting means can be formed so that activation is controlled in accordance with the load ratio on the entire screen or the number of sustain discharge pulses.

Still further, the brightness correction processing per common electrode according to the present invention can be turned ON/OFF in a stepwise or successive manner depending on the purpose of using the image display apparatus, for example, whether the image display apparatus is used for displaying home television broadcasting or is used as a computer display terminal, that is, whether a specific pattern, such as a large window with a large difference in brightness, is often displayed. Also, the brightness correction processing can be turned OFF if not required (in the case of video in which a difference in brightness is difficult to perceive), and can be turned ON only when the processing is highly effective.

Figure 10A:
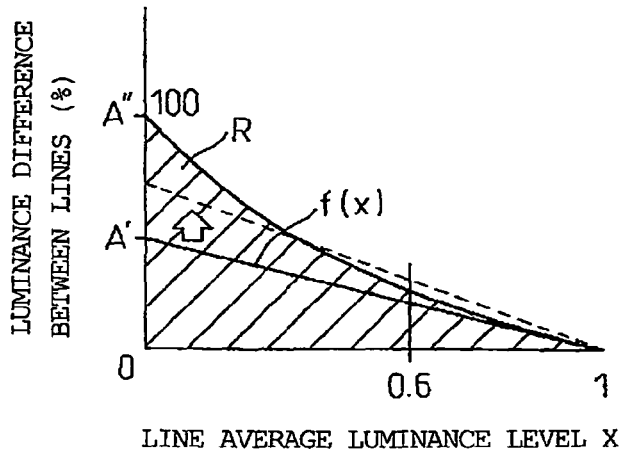
FIG. 10A is a view for explaining a further improvement of the driving method of the image display apparatus according to the present invention.
Figure 10B:
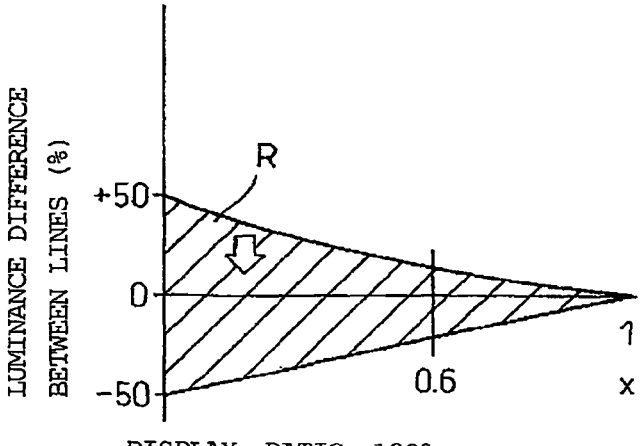
FIG. 10B is a view for explaining a further improvement of the driving method of the image display apparatus according to the present invention.
Figure 10C:
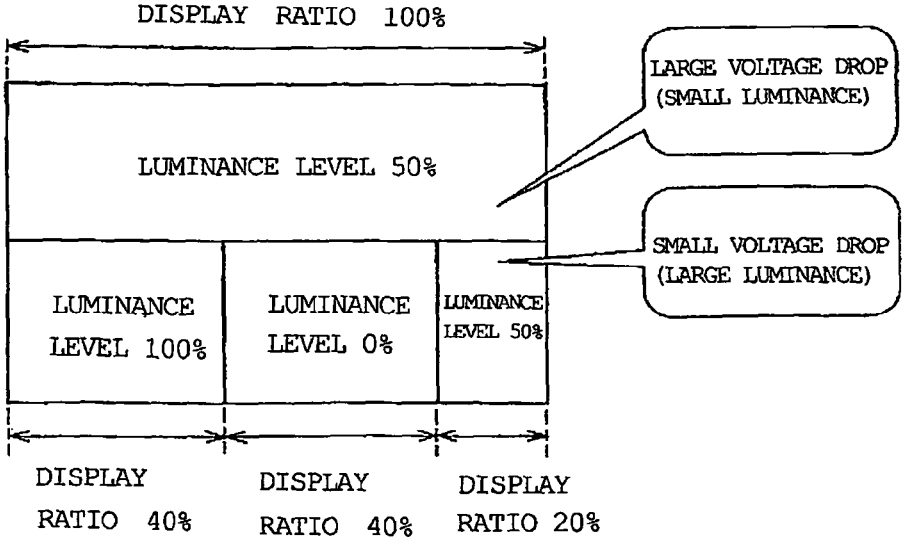
FIG. 10C is a view for explaining a further improvement of the driving method of the image display apparatus according to the present invention.

FIGS. 10A to 10C show views for explaining a further improvement of the image display apparatus according to the present invention. FIGS. 10A and 10B are views for explaining a relation between the coefficient "A" and the correction of the luminance difference between lines, and FIG. 10C shows a specific example of a display image. In FIGS. 10A and 10B, the vertical axis shows a luminance difference between lines (%) and the horizontal axis shows a line average luminance level "X". Further, the reference numeral "R" shows a region in which there is a possibility that the luminance difference between the lines occurs. The reference symbol "f(x)" shows a correction function representing a correction amount, wherein the correction function f(x) satisfies "f(x)=A (1−x)".

However, for example, the above-mentioned line average luminance level "x" has a value of 0.5 in the case of having a portion where the luminance level is 50% and the display ratio is 100%. Similarly thereto, the line average luminance level "x" has a value of 0.5 in the case of having a portion where the luminance level is 100% and the display ratio is 40%, a portion where the luminance level is 0% and the display ratio is 40%, and a portion where the luminance level is 100% and the display ratio is 20%. However, both cases are different from each other in magnitude of voltage drop. FIG. 10C shows the above-mentioned display examples on the display screen.

That is, as shown in FIG. 10C, the voltage drop at an upper section of the display screen (luminance level is 50% and the display ratio is 100%) is large, whereas a lower section of the display screen in the case of (luminance level of 100% and display ratio of 40%)+(luminance level of 0% and display ratio of 40%)+(luminance level of 50% and display ratio of 20%) becomes small. Therefore, in the luminance at a 20% portion on a right side, the lower portion on the display screen becomes relatively larger than the upper portion thereon.

This is because even if the line average luminance levels "x" are the same, a ratio of the voltage drop is different depending on the video content. Herein, since the correction function f(x) can vary on only a line satisfying the equation "f(x)=A (1−x)", excess or deficiency of the correction amount occurs due to the video content.

In this case, to avoid a side effect due to excessive correction etc., the correction amount is set at, for example, approximately 50% of the Y-intercept A' on the maximum luminance difference between lines (the Y-intercept A' in FIG. 10A, i.e., f(x)=0.5 (1−x)). For this reason, as shown in FIG. 10B, the luminance difference between lines of 0 to +100% of FIG. 10A is replaced by that of approximately −50% to +50% (0 to +50% as an absolute value), so that the present invention can obtain an effect of reducing an amount of the luminance difference between lines by half. This setting is appropriate to the normal video. Note that the setting of the above-mentioned coefficient "A" is not limited to, for example, a linear correction function as shown in FIG. 8A and can be widely applied to various-shapes correction functions (correction curvature) as shown in FIGS. 8A and 8B, etc. This is the same as the cases of FIGS. 11A to 14 to be described as follows. The function "f(x)" may be various functions other than the function "f(x)=A(1−x)" or any relational expression.

In addition, for the specific video in which the luminance difference between lines is large and is particularly prominent, for example, the Y-intercept A" in FIG. 10A, that is, only a vicinity of the line having the maximum value of the luminance difference between lines is detected, thereby making it possible to enlarge the correction amount limitedly. More specifically, for example, the switching condition is determined in accordance with the load of the entire screen to be displayed (entire-surface average luminance level "L"), and a transfer of a parameter (coefficient A) from A' to A" can be controlled.

Figure 11A:
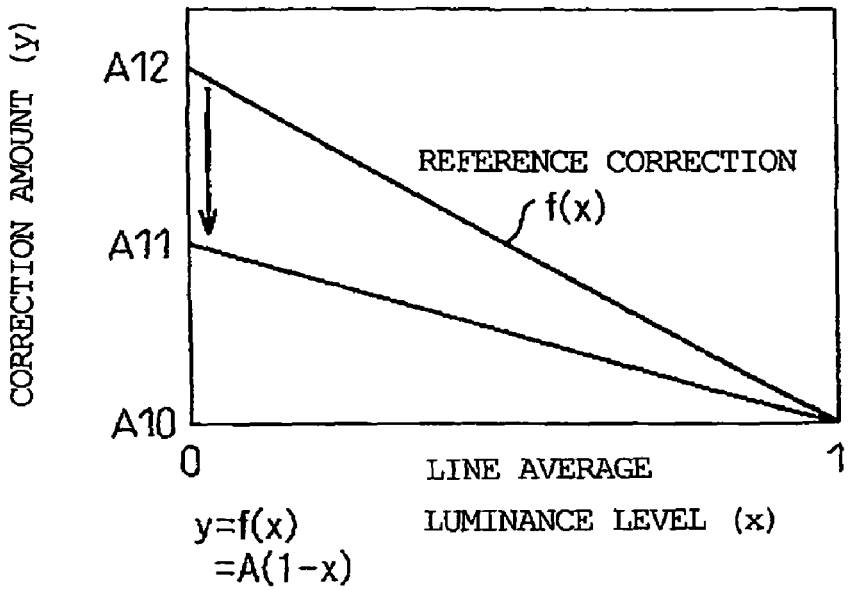
FIG. 11A is a view for explaining a first embodiment of the driving method of the image display apparatus according to the present invention.
Figure 11B:
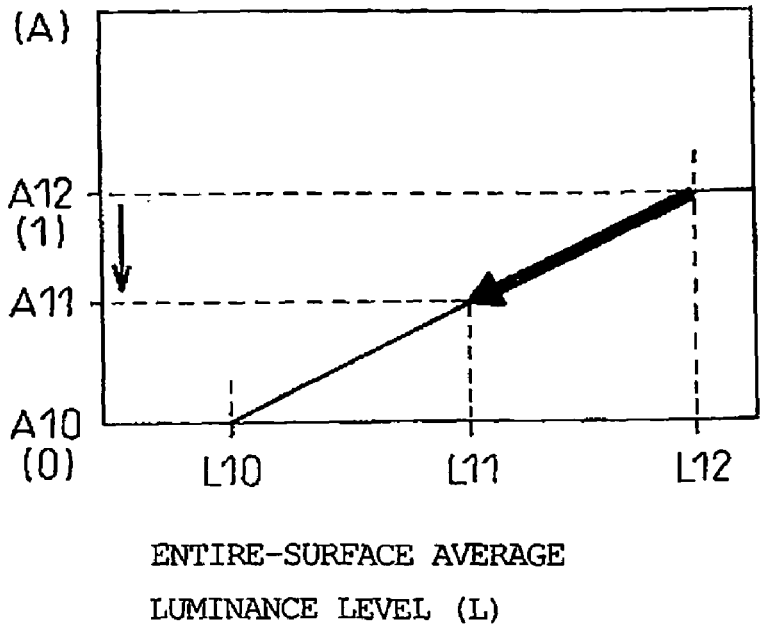
FIG. 11B is a view for explaining a first embodiment of the driving method of the image display apparatus according to the present invention.

FIGS. 11A and 11B are views for explaining a first embodiment of the driving method of the image display apparatus according to the present invention. FIG. 11A shows a relation between a line average luminance level (x) and a correction amount (y), and FIG. 11B shows a relation between an entire-surface average luminance level (L) and a coefficient (A).

As shown in FIG. 11A, in this modified example, the coefficient "A" satisfying the function "f(x)=A(1−x)" as shown by referring to FIG. 10 is arbitrarily set based on the entire-surface average luminance level (average luminance level in a signal corresponding to the entire surface on the inputted video signal) L. Note that the coefficient "A" is within a range of "0≦A≦1" and, for example, "A12=1", "A11=0.5", and "A10=0".

A reference correction f(x) in FIG. 11A shows the case where the entire-surface average luminance level "L" is the maximum value (e.g., the maximum gray-scale among all the pixels of the surface) L12, and the correction amount "y" becomes y=A12×(1−x). In addition, for example, when the entire-surface average luminance level "L" is changed from L12 to L11, the coefficient "A" is changed from A12 to A11 and the correction amount "y" becomes small like "y=A11·f(x)", i.e., "y=0.5(1−x)".

Thus, in the first embodiment of the driving method of the image display apparatus, the coefficient "A" is set in accordance with the entire-surface average luminance level "L" and, for example, in the case of the dark image as a whole (when the "L" is small), the excessive correction is prevented by decreasing the correction amount. Note that as the entire-surface average luminance level "L", it is possible to, for example, employ the value obtained from the above-mentioned APC circuit without change or employ a summation of the entirety of one screen for each line obtained from the load calculating means 82. The entire-surface average luminance level is obtained from the display loads on the entire display screen and has a close relation with the number of sustains (the number of pulses of the sustains) and may be replaced by another parameter having a relation with the number of sustains or the display load of the entire display screen.

Figure 12A:
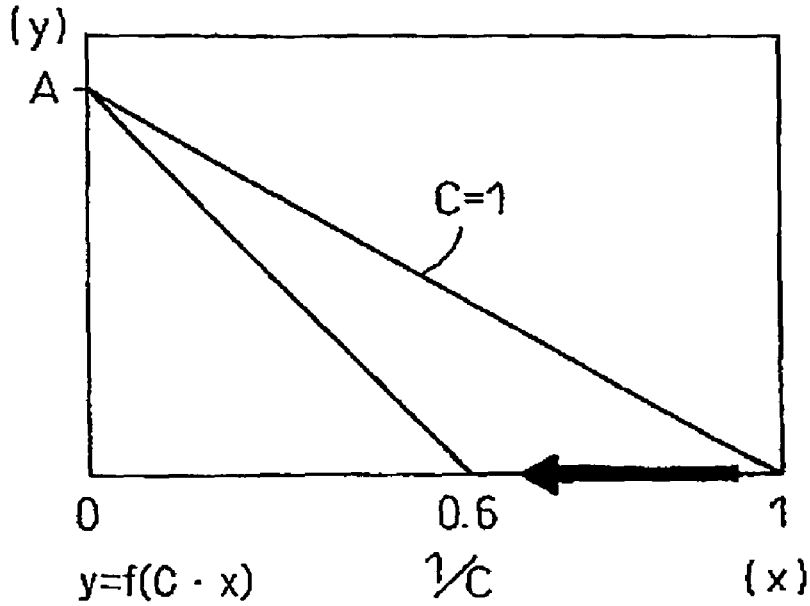
FIG. 12A is a view for explaining a second embodiment of the driving method of the image display apparatus according to the present invention.
Figure 12B:
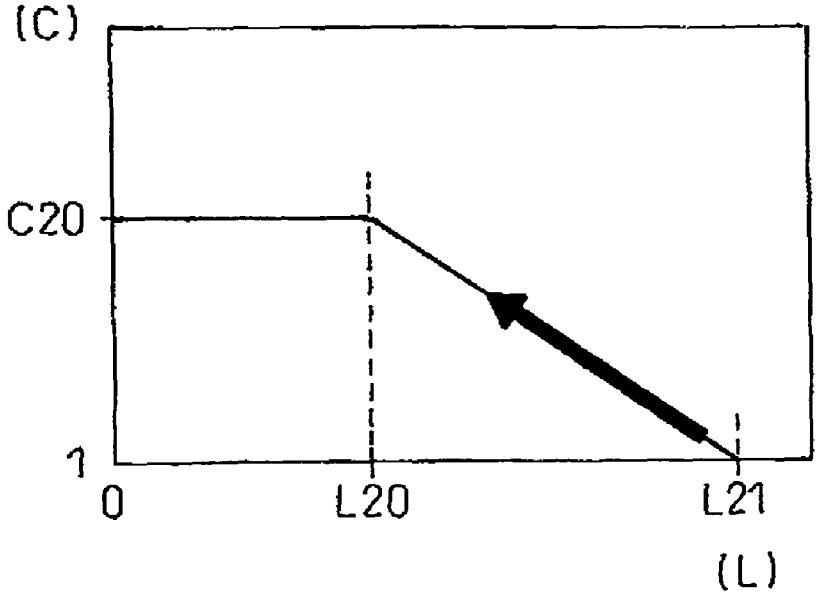
FIG. 12B is a view for explaining a second embodiment of the driving method of the image display apparatus according to the present invention.

FIGS. 12A and 12B are views for explaining a second embodiment of the driving method of the image display apparatus according to the present invention. FIG. 12A shows a relation between a line average luminance level (x) and a correction amount (y), and FIG. 12B shows a relation between a entire-surface average luminance level (L) and a coefficient (C).

However, in the dark video in whole, since a variable range of the line average luminance level x is narrow, a decrease of gains occurs in whole, thereby making it impossible to improve sufficiently the luminance difference between lines. Therefore, in the second embodiment of the driving method of the image display apparatus, a dynamic range is expanded by multiplying the line average luminance level x by the coefficient C (≧1).

Specifically, for example, for all the cells on one line, if signal amplitude is 100% and the display ratio is 100%, the line average luminance level x can satisfy "x=1". However, for example, when the signal amplitude is 60%, the line average luminance level x does not satisfy "x>0.6" even if the display ratio is 100%. Due to this, by multiplying the line average luminance level x by the coefficient C (e.g., C=C20≈1.7), the "C·x" can be varied up to satisfaction of "C·x=1". That is, the second embodiment of the driving method of the image display apparatus sets the coefficient C in accordance with the entire-surface average luminance level L, obtaining the correction amount y from "y=f(C·x)", and carries out the luminance correction within the expanded dynamic range. However, when C·x>1, C·x=1.

Figure 13A:
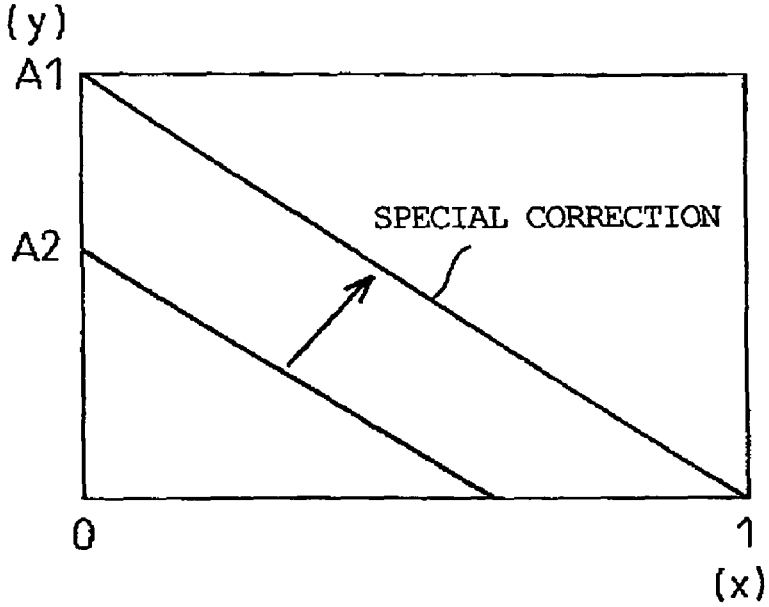
FIG. 13A is a view for explaining a third embodiment of the driving method of the image display apparatus according to the present invention.
Figure 13B:
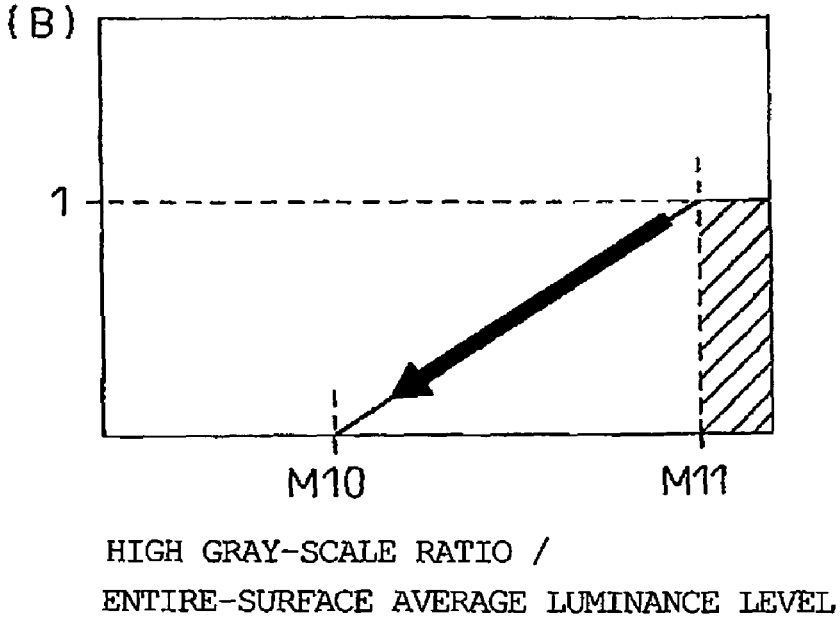
FIG. 13B is a view for explaining a third embodiment of the driving method of the image display apparatus according to the present invention.

FIGS. 13A and 13B are views for explaining a modified example of the third embodiment of the driving method of the image display apparatus according to the present invention. FIG. 13A shows a relation between a line average luminance level (x) and a correction amount (y), and FIG. 13B shows a relation between a high gray-scale ratio (M) (value obtained by dividing a rate of the entire pixel with higher luminance than that of the reference value by the entire-surface average luminance level) and the coefficient (B).

However, for example, in such a video (video with high gray-scale ratio) that the pixels with high gray-scale levels such as animation occur in its larger part, the luminance difference between lines is easily prominent and the side effect little occurs even if control is executed by the above-mentioned correction. Therefore, for the above video with high gray-scale ratio such as animation, the third embodiment of the driving method of the image display apparatus is intended to obtain the maximum effect by changing the correction amount "y" to a special correction.

In the driving method of the image display apparatus in the third embodiment, the coefficient "B" is set based on the high gray-scale ratio "M". By using the coefficient "B" set based on the high gray-scale ratio "M", the correction amount "y" is obtained from "y=B·f1(x)+(1−B)·f2(x)", whereby the luminance correction is carried out. Note that, in this example, f1(x) is "A1(1−x)" and f2(x) is "A2(1−C·x)".

That is, in the case where the high gray-scale ratio "M" is sought in the entire display screen and a value of "M" shown in, for example, FIG. 13B exceeds M11, the special correction by "y=f1(x)" is carried out by setting the coefficient "B" at 1 (one), whereby the luminance difference between lines is carried sufficiently. In this case, the detection of the pixel with higher luminance than that of the reference value can be conducted by making a detection of, for example, whether luminance weight uses the maximum subfield.

Figure 14:
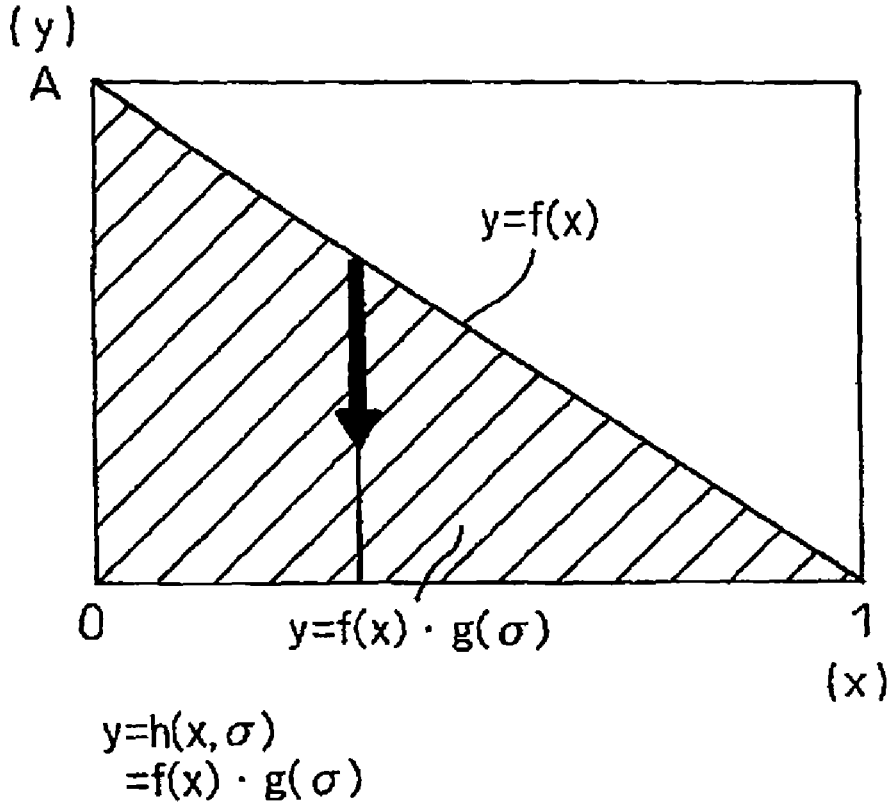
FIG. 14 is a view for explaining a fourth embodiment of the driving method of the image display apparatus according to the present invention.

FIG. 14 is a view for explaining a fourth embodiment of the driving method of the image display apparatus according to the present invention, and shows a relation between an amount (line deviation: σ), which represents luminance non-uniformity of a line average luminance level (x), and each pixel (cell) on one line and a correction amount (y).

That is, in the driving method of the image display apparatus in the fourth embodiment, the correction amount (y) is defined by a two-dimensional function (y=h(x, σ)=f(x)·g(σ)) including the line average luminance level "x" and the deviation "σ"

Incidentally, for example, even if the line average luminance level x is the same, the voltage drop when the luminance level is 50% and the entire pixels are displayed (display ratio of 100%) is different from the voltage drop when the luminance level is 100% and 50% of pixels is displayed (display ratio of 50%). That is, the former becomes larger. For this reason, the driving method of the image display apparatus in this fourth embodiment discriminates between both cases by using the deviation (variation) "σ" of the luminance level, and control the correction amount "y" so as to be made small in the former case (deviation σ is small) or to be made large in the latter case (deviation σ is large), whereby the correction accuracy is intended to be improved.

In an example of FIG. 14, by multiplying a line "y=f(x)" by "g(σ)", the entire region under the line is covered. According to the driving method of the image display apparatus in the fourth embodiment, "g(σ)" operates so as to increase the correction amount when the deviation σ is large while to decrease the correction amount when the deviation σ is small, whereby such an appropriate correction as to depend on the contents of the video can be carried out.

In the foregoing description, the present invention can be widely applied to, for example, an image display apparatus driven by the common driving electrode per predetermined number of pixels or per predetermined display region on the display panel, such as a plasma display apparatus, having a plurality of pixels. The present invention can be applied not only to the image display apparatus for color display but also to the image display apparatus for monochrome display. Also, it is described in the present embodiment that calculation is made from the R, G and B signals. Alternatively, as a matter of course, calculation can be made from a Y signal (luminance signal) for use in television and others. In addition, to obtain the correction function, the line average luminance level, the entire-surface average luminance level, and the variation σ, etc. are used. However, needless to say, it is possible to seek the line load per subfield and further use a method of predicting the decrease of luminance.

(Note 1) A driving method of an image display apparatus, in which a signal at a same luminance level is inputted to a pixel on a display panel and is displayed, comprises the step of: when a line load ratio of a line including said pixel is changed, an On pattern of a subfield in one field is changed.

(Note 2) A driving method of an image display apparatus, which is driven by a common driving electrode per predetermined number of pixels or per predetermined display region in a display panel having a plurality of pixels, comprises the steps of: calculating, per said common driving electrode, a functional amount associated with a brightness in accordance with an image to be displayed; and based on the calculated functional amount, correcting the brightness of the image to be displayed on said predetermined number of pixels or said predetermined display region driven by said common driving electrode.

(Note 3) In the driving method of an image display apparatus according to note 2, said functional amount is calculated by calculating an average luminance level of a signal corresponding to said predetermined number of pixels or said predetermined display region driven by said common driving electrode in an inputted video signal.

(Note 4) In the driving method of an image display apparatus according to note 2, said functional amount is calculated by calculating an average luminance level of a signal corresponding to said predetermined number of pixels or said predetermined display region driven by said common driving electrode in an inputted video signal, and an entire-surface average luminance level of a signal corresponding to an entirety of display screen of said inputted video signal.

(Note 5) In the driving method of an image display apparatus according to note 4, when an average luminance level of a signal corresponding to said predetermined number of pixels or said predetermined display region is set as "x" and a correction amount with image brightness displayed by said predetermined number of pixels or said predetermined display region is set as "y" and a functional amount calculated by said average luminance level "x" is set as "f(x)" and a coefficient "A" varying in accordance with said entire-surface average luminance level is set as "A", said correction amount "y" satisfies "y=A·f(x)".

(Note 6) In the driving method of an image display apparatus according to note 4, when an average luminance level of a signal corresponding to said predetermined number of pixels or said predetermined display region is set as "x" and a correction amount with image brightness displayed by said predetermined number of pixels or said predetermined display region is set as "y" and a functional amount calculated by said average luminance level "x" is set as "f(x)" and a coefficient "C" varying in accordance with said entire-surface average luminance level is set as "A", said correction amount "y" satisfies "y=f(C·x)".

(Note 7) In the driving method of an image display apparatus according to note 2, said functional amount is calculated by calculating an average luminance level of a signal corresponding to said predetermined number of pixels or said predetermined display region driven by said common driving electrode in an inputted video signal, an entire-surface average luminance level of a signal corresponding to an entirety of a display screen of said inputted video signal, and a high gray-scale ratio higher than a predetermined gray-scale of a signal corresponding to said entirety of display screen.

(Note 8) In the driving method of an image display apparatus according to note 7, when an average luminance level of a signal corresponding to said predetermined number of pixels or said predetermined display region is set as "x" and a correction amount with image brightness displayed by said predetermined number of pixels or said predetermined display region is set as "y" and first and second functional amounts calculated by said average luminance level "x" are set as "f1(x)" and "f2(x)", respectively, and a coefficient "B" varying in accordance with said high gray-scale ratio is set as "B", said correction amount "y" satisfies "y=B·f1(x)+(1−B)·f2(x)".

(Note 9) In the driving method of an image display apparatus according to note 2, said functional amount is calculated by calculating a variation of an average luminance level of a signal corresponding to said predetermined number of pixels or said predetermined display region driven by said common driving electrode in an inputted video signal, and a luminance level in said predetermined number of pixels or said predetermined display region driven by said common driving electrode.

(Note 10) In the driving method of an image display apparatus according to note 9, when an average luminance level of a signal corresponding to said predetermined number of pixels or said predetermined display region is set as "x" and a correction amount with image brightness displayed by said predetermined number of pixels or said predetermined display region is set as "y" and a functional amount calculated by said average luminance level "x" is set as "f(x)" and a variation amount of luminance levels in said predetermined number of pixels or said predetermined display region is set as "σ" and a functional amount calculated by said variation amount "σ" is set as "g(σ)", said correction amount "y" satisfies "y=f(x)·g(σ)".

(Note 11) In the driving method of an image display apparatus according to note 2, the functional amount calculation is performed by calculating an amount of data associated with a signal voltage drop of an input video signal corresponding to either of the predetermined number of pixels and the predetermined display region driven by the common driving electrode.

(Note 12) In the driving method of an image display apparatus according to note 2, said brightness is corrected by adjusting a gain of an inputted video signal and correcting the brightness of the image to be displayed on said predetermined number of pixels or said predetermined display region driven by said common driving electrode.

(Note 13) In the driving method of an image display apparatus according to note 2, the brightness is corrected by adjusting a gamma characteristic of an inputted video signal and correcting the brightness of the image to be displayed on said predetermined number of pixels or said predetermined display region driven by said common driving electrode.

(Note 14) In the driving method of image display apparatus according to note 2, the brightness is corrected by using an approximately linear characteristic based on said calculated functional amount to correct the brightness of the image to be displayed on said predetermined number of pixels or said predetermined display region driven by said common driving electrode.

(Note 15) In the driving method of an image display apparatus according to note 2, the brightness is corrected by using a non-linear characteristic based on said calculated functional amount to correct the brightness of the image to be displayed on said predetermined number of pixels or said predetermined display region driven by said common driving electrode.

(Note 16) In the driving method of an image display apparatus according to note 2, the brightness is corrected by using a combination function of approximately linear characteristics based on said calculated functional amount to correct the brightness of the image to be displayed on said predetermined number of pixels or said predetermined display region driven by said common driving electrode.

(Note 17) In the driving method of an image display apparatus according to note 2, the brightness is corrected by turning ON/OFF, in a stepwise or successive manner, a function of controlling the brightness of the image to be displayed on said predetermined number of pixels or said predetermined display region driven by said common driving electrode, in accordance with a video content to be displayed on said image display apparatus.

(Note 18) In the driving method of an image display apparatus according to note 2, the brightness is corrected by turning ON/OFF, in a stepwise or successive manner, a function of controlling the brightness of the image to be displayed on said predetermined number of pixels or said predetermined display region driven by said common driving electrode, in accordance with a purpose of using said image display apparatus.

(Note 19) In the driving method of an image display apparatus according to note 2, calculating said functional amount and correcting said brightness are carried out by changing the correction amount in a stepwise or successive manner when automatic power control is effective and ineffective.

(Note 20) In the driving method of an image display apparatus according to note 2, calculating said functional amount and correcting said brightness are such that activation is controlled in accordance with a load ratio of an entire screen or a number of sustain discharge pulses.

(Note 21) In the driving method of an image display apparatus according to note 2, said functional amount is calculated by: converting a signal, which corresponds to said predetermined number of pixels or said predetermined display region driven by said common driving electrode in an inputted video signal, to a combination of a plurality of subfields having a predetermined luminance weight; and thereafter calculating a load ratio per line of each subfield.

(Note 22) An image display apparatus using a display panel having a plurality of pixels comprises: a load calculating means for calculating, at a time of inputting and displaying a signal with a same luminance level to a pixel on a display panel, a line load ratio of a line including said pixel; and a correcting means for correcting a luminance by changing an On pattern of a subfield in one field.

(Note 23) An image display apparatus using a display panel having a plurality of pixels comprises: a load calculating means for calculating a load ratio of each of a plurality of pixels connected to one driving electrode; and a luminance correcting means for calculating and correcting, based on an output of said load calculating means, a drop amount of luminance level of an inputted video signal.

(Note 24) In the image display apparatus according to note 22, said luminance correcting means calculates and correcting a drop amount of voltages of said inputted video signal.

(Note 25) In the image display apparatus according to note 22, said load calculating means and said luminance correcting means are activated when automatic power control is effective, and is deactivated when the automatic power control is ineffective.

(Note 26) In the image display apparatus according to note 22, activation of said load calculating means and said luminance correcting means is controlled in accordance with a load ratio of an entire screen or a number of sustain discharge pulses.

(Note 27) An image display apparatus, driven by a common driving electrode per predetermined number of pixels or per predetermined display region in a display panel having a plurality of pixels, comprises: a calculating means for calculating, per said common driving electrode, a functional amount associated with a brightness in accordance with an image to be displayed; and a correcting means for correcting, based on an output of said calculating means, the brightness of the image to be displayed on said predetermined number of pixels or predetermined display region driven by said common driving electrode.

(Note 28) In the image display apparatus according to note 27, said calculating means calculates an average luminance level of a signal corresponding to said predetermined number of pixels or said predetermined display region driven by said common driving electrode in an inputted video signal.

(Note 29) In the image display apparatus according to note 27, said calculating means calculates an amount of data associated with a voltage drop of a signal corresponding to said predetermined number of pixels or said predetermined display region driven by said common driving electrode in an inputted vide signal.

(Note 30) In the driving method of an image display apparatus according to note 27, said calculating means is calculated by calculating an average luminance level of a signal corresponding to said predetermined number of pixels or said predetermined display region driven by said common driving electrode in an inputted video signal, and an entire-surface average luminance level of a signal corresponding to an entirety of display screen of said inputted video signal.

(Note 31) In the driving method of an image display apparatus according to note 30, when an average luminance level of a signal corresponding to said predetermined number of pixels or said predetermined display region is set as "x" and a correction amount with image brightness displayed by said predetermined number of pixels or said predetermined display region is set as "y" and a functional amount calculated by said average luminance level "x" is set as "f(x)" and a coefficient "A" varying in accordance with said entire-surface average luminance level is set as "A", said correction amount "y" satisfies "y=A·f(x)".

(Note 32) In the driving method of an image display apparatus according to note 30, when an average luminance level of a signal corresponding to said predetermined number of pixels or said predetermined display region is set as "x" and a correction amount with image brightness displayed by said predetermined number of pixels or said predetermined display region is set as "y" and a functional amount calculated by said average luminance level "x" is set as "f(x)" and a coefficient "C" varying in accordance with said entire-surface average luminance level is set as "A", said correction amount "y" satisfies "y=f(C·x)".

(Note 33) In the driving method of an image display apparatus according to note 30, said calculating means is calculated by calculating an average luminance level of a signal corresponding to said predetermined number of pixels or said predetermined display region driven by said common driving electrode in an inputted video signal, an entire-surface average luminance level of a signal corresponding to an entirety of a display screen of said inputted video signal, and a high gray-scale ratio higher than a predetermined gray-scale of a signal corresponding to said entirety of display screen.

(Note 34) In the driving method of an image display apparatus according to note 33, when an average luminance level of a signal corresponding to said predetermined number of pixels or said predetermined display region is set as "x" and a correction amount with image brightness displayed by said predetermined number of pixels or said predetermined display region is set as "y" and first and second functional amounts calculated by said average luminance level "x" are set as "f1(x)" and "f2(x)", respectively, and a coefficient "B" varying in accordance with said high gray-scale ratio is set as "B", said correction amount "y" satisfies "y=B·f1(x)+(1−B)·f2(x)".

(Note 35) In the driving method of an image display apparatus according to note 27, said calculating means is calculated by calculating a variation of an average luminance level of a signal corresponding to said predetermined number of pixels or said predetermined display region driven by said common driving electrode in an inputted video signal, and a luminance level in said predetermined number of pixels or said predetermined display region driven by said common driving electrode.

(Note 36) In the driving method of an image display apparatus according to note 35, when an average luminance level of a signal corresponding to said predetermined number of pixels or said predetermined display region is set as "x" and a correction amount with image brightness displayed by said predetermined number of pixels or said predetermined display region is set as "y" and a functional amount calculated by said average luminance level "x" is set as "f(x)" and a variation amount of luminance levels in said predetermined number of pixels or said predetermined display region is set as "σ" and a functional amount calculated by said variation amount "σ" is set as "g(σ)", said correction amount "y" satisfies "y=f(x)·g(σ)".

(Note 37) In the image display apparatus according to note 27, said correcting means adjusts a gain of an inputted video signal and corrects the brightness of the image to be displayed on said predetermined number of pixels or said predetermined display region driven by said common driving electrode.

(Note 38) In the image display apparatus according to note 27, said correcting means adjusts a gamma characteristic of an inputted video signal and corrects the brightness of the image to be displayed on said predetermined number of pixels or said predetermined display region driven by said common driving electrode.

(Note 39) In the image display apparatus according to note 27, said correcting means uses an approximately linear characteristic based on an output of said calculated means to correct the brightness of the image to be displayed on said predetermined number of pixels or said predetermined display region driven by said common driving electrode.

(Note 40) In the image display apparatus according to note 27, said correcting means uses a non-linear characteristic based on an output of said calculating means to correct the brightness of the image to be displayed on said predetermined number of pixels or said predetermined display region driven by said common driving electrode.

(Note 41) In the image display apparatus according to note 27, said correcting means uses a combination function of approximately linear characteristics based on an output of said calculating means to correct the brightness of the image to be displayed on said predetermined number of pixels or said predetermined display region driven by said common driving electrode.

(Note 42) In the image display apparatus according to note 27, said correcting means turns ON/OFF and corrects, in a stepwise or successive manner, a function of controlling the brightness of the image to be displayed on said predetermined number of pixels or said predetermined display region driven by said common driving electrode, in accordance with a video content to be displayed on said image display apparatus.

(Note 43) In the image display apparatus according to note 27, said correcting means turns ON/OFF and corrects, in a stepwise or successive manner, a function of controlling the brightness of the image to be displayed on said predetermined number of pixels or said predetermined display region driven by said common driving electrode, in accordance with a purpose of using said image display apparatus.

(Note 44) In the image display apparatus according to note 27, said calculating means and said correcting means are activated when automatic power control is effective, and are deactivated when the automatic power control is ineffective.

(Note 45) In the image display apparatus according to note 27, said load calculating means and said luminance correcting means are such that activation is controlled in accordance with a load ratio of an entire screen or a number of sustain discharge pulses.

The present invention can be widely applied to, for example, a display apparatus for personal computer and work station, a flat-type wall-mounted television, a plasma display apparatus for use as apparatuses for displaying advertisement, information, and others, or image display apparatuses driven by the common driving electrode per predetermined number of pixels or per predetermined display region on the display panel, such as an EL panel, having a plurality of pixels.

What is claimed is:

1. A method of driving a plasma display panel, comprising:

calculating line load ratio data corresponding to a line load ratio per one display line based on an inputted image signal; and calculating deviation data corresponding to a deviation of the line load ratio per one display line, wherein, in correcting and displaying brightness per one display line based on the line load ratio data and the deviation data, brightness of an image is corrected and displayed by correction per one display line, regarding first and second lines that are display lines different within a same display screen, so that:

when the first line has the line load ratio larger than that of the second line, even if the inputted image signal corresponding to a first pixel included in the first line has a same brightness level as the inputted image signal corresponding to a second pixel included in the second line, a display luminance level, which determines an ON pattern of a plurality of subfields corresponding to the first pixel, is made higher than the display luminance level corresponding to the second pixel; and when the first line has the same line load ratio as the second line and the first line has the deviation data larger than that of the second line, even if the inputted image signal corresponding to a third pixel included in the first line has a same luminance level as the inputted image signal corresponding to a fourth pixel included in the second line, the display luminance level corresponding to the third pixel is made smaller than the display luminance level corresponding to the fourth pixel.

2. The method according to claim 1, further comprising:

calculating display-screen load ratio data of an entire display screen corresponding to a load ratio per one display screen based on the inputted image signal, wherein the brightness is corrected and displayed only when the display-screen load ratio data is larger than or equal to a predetermined level.

3. The method according to claim 2, the predetermined level is a value of the display-screen load ratio data where automatic power control is activated.

4. The method according to claim 1, wherein the brightness is corrected per one display line by adjusting a gain of the inputted image signal.

* * * * *